US006577276B2

(12) United States Patent
Lovestead

(10) Patent No.: US 6,577,276 B2
(45) Date of Patent: Jun. 10, 2003

(54) LOW CROSS-POLARIZATION MICROSTRIP PATCH RADIATOR

(75) Inventor: Raymond L. Lovestead, Superior, CO (US)

(73) Assignee: ARC Wireless Solutions, Inc., Wheat Ridge, CO (US)

( * ) Notice: Subject to any disclaimer, the term of this patent is extended or adjusted under 35 U.S.C. 154(b) by 0 days.

(21) Appl. No.: 10/002,240

(22) Filed: Nov. 15, 2001

(65) Prior Publication Data

US 2002/0089452 A1 Jul. 11, 2002

Related U.S. Application Data

(60) Provisional application No. 60/249,309, filed on Nov. 16, 2000.

(51) Int. Cl.[7] ..... H01Q 1/38
(52) U.S. Cl. ..... 343/700 MS
(58) Field of Search ..... 343/700 MS, 829, 343/830, 846; H01Q 1/24, 1/38

(56) References Cited

U.S. PATENT DOCUMENTS

| | | | | | |
|---|---|---|---|---|---|
| 4,220,957 | A | | 9/1980 | Britt | |
| 4,665,405 | A | | 5/1987 | Drabowitch et al. | |
| 4,926,189 | A | * | 5/1990 | Zaghloul et al. | 343/700 MS |
| 4,929,959 | A | * | 5/1990 | Sorbello et al. | 343/700 MS |
| 5,410,323 | A | * | 4/1995 | Kuroda | 343/700 MS |
| 5,453,751 | A | * | 9/1995 | Tsukamoto et al. | 343/700 MS |
| 5,534,877 | A | * | 7/1996 | Sorbello et al. | 343/700 MS |
| 5,561,435 | A | | 10/1996 | Nalbandian et al. | |
| 5,815,121 | A | | 9/1998 | Collier | |
| 6,069,590 | A | | 5/2000 | Thompson, Jr. et al. | |
| 6,150,991 | A | | 11/2000 | Hulderman | |
| 6,166,701 | A | | 12/2000 | Park et al. | |
| 6,184,833 | B1 | | 2/2001 | Tran | |
| 6,229,484 | B1 | * | 5/2001 | Sagisaka | 343/700 MS |
| 6,310,584 | B1 | | 10/2001 | Reece et al. | |
| 6,400,322 | B2 | * | 6/2002 | Fang et al. | 343/700 MS |

* cited by examiner

*Primary Examiner*—Tho Phan
(74) *Attorney, Agent, or Firm*—Ancel W. Lewis, Jr.

(57) ABSTRACT

A microstrip patch radiator has parallel conductive strips that are connected at opposite ends by conductive connecting strips and separated by slits. The slits are parallel to the direction of the desired patch currents, and perpendicular to the undesired currents, to provide a low impedance path for currents generating the desired antenna polarization, and a high impedance path for orthogonal currents generating the undesired, cross-polarized radiation of the patch.

9 Claims, 3 Drawing Sheets

LOW CROSS-POLARIZATION MICROSTRIP PATCH RADIATOR

This application claims the benefit under 35 U.S.C. §119(e) of the U.S. provisional patent application No. 60/249,309 filed Nov. 16, 2000.

TECHNICAL FIELD

The present invention relates to antennas and more particularly to a microstrip patch radiator having low cross-polarization.

BACKGROUND ART

Orthogonally oriented polarized sets of antennas can provide dual use of a bandwidth. Low cross-polarized antennas are required to take advantage of this dual use of bandwidth. Prior known low cross-polarized antennas are multilayered antenna structures that are relatively expensive and complex.

DISCLOSURE OF THE INVENTION

A microstrip patch radiator is disclosed including a conductive patch with a plurality of parallel conductive strips divided by spaced slits parallel to the direction of the desired patch currents, with the conductive strips being connected along opposite ends. The radiator may be round, square, rectangular or any other shape symmetrical about an axis perpendicular to the slits.

BRIEF DESCRIPTION OF THE DRAWINGS

Details of this invention are described in connection with the accompanying drawings that bear similar reference numerals in which.

DETAILED DESCRIPTION OF THE INVENTION

Figure 1A:
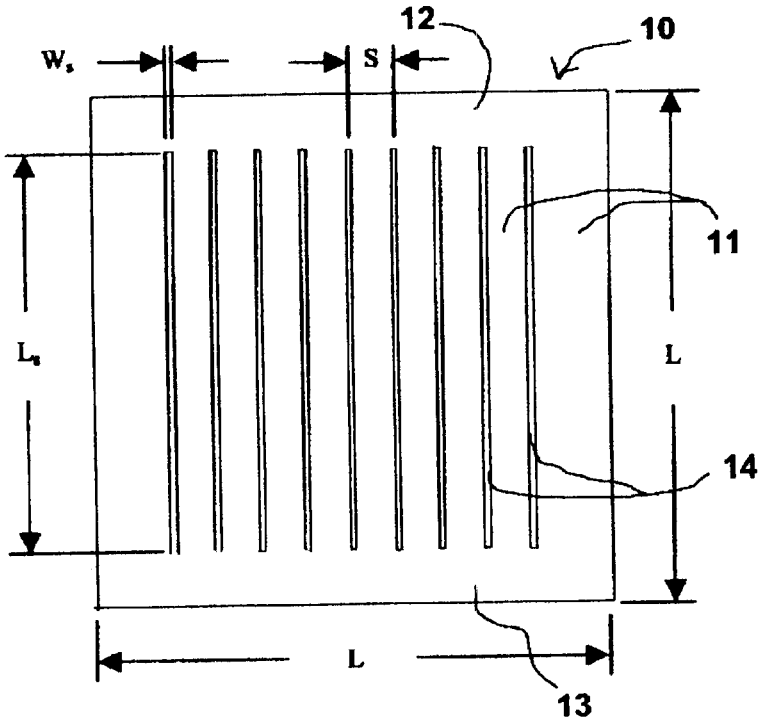
FIG. 1A is a top view of a square radiator embodying features of the present invention.
Figure 1B:
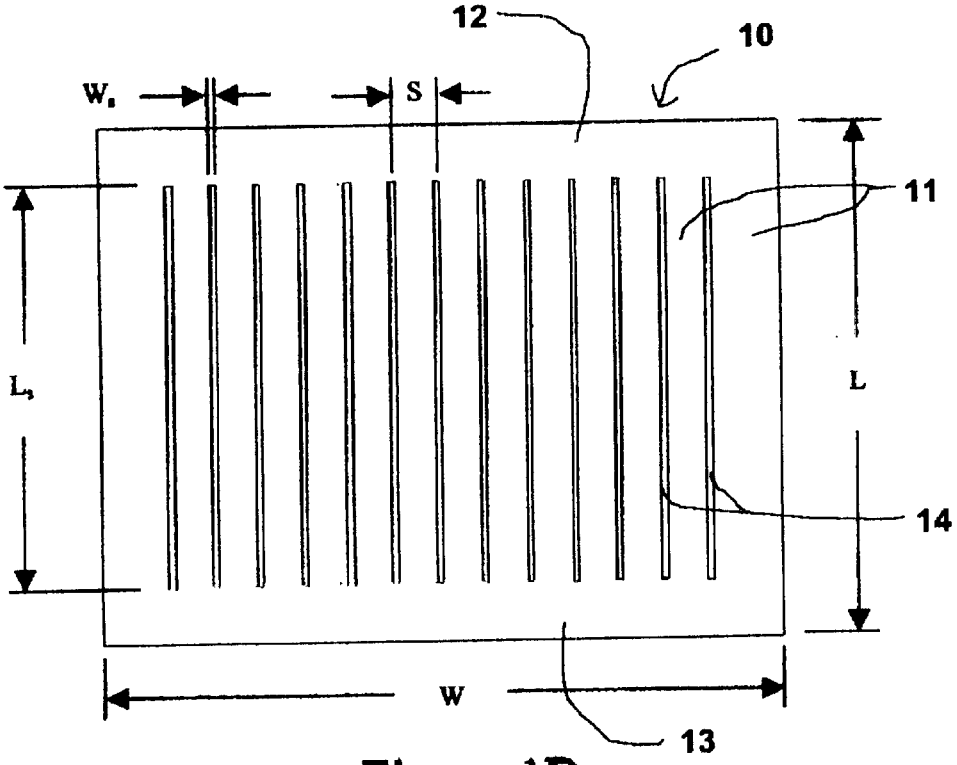
FIG. 1B is a top view of a rectangular radiator embodying features of the present invention.
Figure 1C:
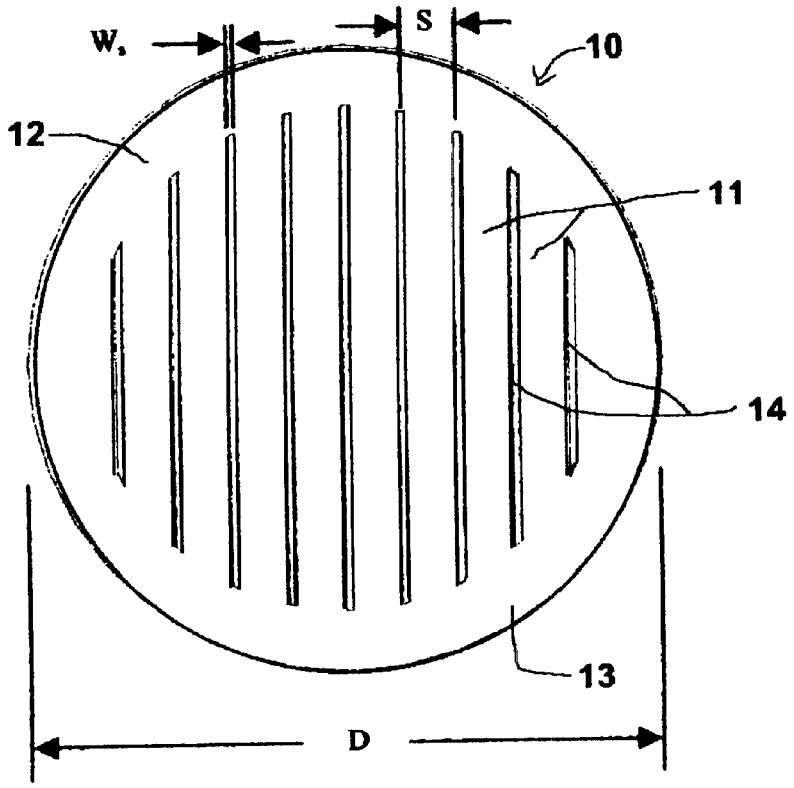
FIG. 1C is a top view of a circular radiator embodying features of the present invention.

Referring now to FIGS. 1A, 1B and 1C, the patch radiator of the present invention includes an electrically conductive patch 10 having a plurality of elongated, spaced, parallel conductive strips 11. The patch 10 is a geometric shape such as a square as shown in FIG. 1A, a rectangle as shown in FIG. 1B or a circle as shown in FIG. 1C. The patch 10 may be any shape that is symmetrical about an axis that is perpendicular to the strips 11. The strips 11 are all connected at one end by a conductive first connecting portion 12 and at opposite end by a conductive second connecting portion 13. The strips 11 are divided by a plurality of parallel spaced slits 14 extending from the first connecting portion 12 to the second connecting portion 13, with the first and second connecting portions 12 and 13 forming constant potential strips at opposite ends of the patch 10. Slits 14 are shown as uniformly spaced. The patch 10 is preferably made from a single piece of conductive material, with the slits 14 being formed by etching or cutting to create the strips 11, the first connecting portion 12 and the second connecting portion 13.

The slits 14 reduce the cross-polarized radiation generated by the undesired currents in the antenna. These undesired currents are produced either by mutual coupling from nearby structures or unbalanced feeding and/or patch radiator shape. The slits 14 are parallel to the direction of the desired patch currents, and perpendicular to the undesired currents. The slits 14 serve to provide a low impedance path for currents generating the desired antenna polarization, and a high impedance path for orthogonal currents generating the undesired, cross-polarized radiation of the patch 10. Since the undesired currents are associated with an undesired radiation mode, the slits 14 are used as mode suppressors.

The number, location, and spacing of the slits 14 are chosen to optimally suppress cross-polarized radiation while minimizing degradation of the microstrip patch radiator's input impedance. The slits 14 provide performance enhancement over a significant range of dimensional values. The slit length $L_S$, can range from 0.5L to 0.9L, where L is the length of the rectangular and square patch 10. For a circular patch 10 with a diameter D, the annular band around the slit region can vary from 0.05D to 0.25D in thickness with the individual slit lengths varying accordingly across the patch 10.

The number of parallel slits 14 can vary from 4 for narrow patches up to as many as 50. Control of the patch currents near the side edges of the patch 10 is not possible if too few slits are used. On the other hand, the input impedance of the patch 10 will be altered if too many slits are utilized. The width of the strips 11 and resulting spacing S between the slits 14 can be either uniform, as shown in the Figures, or non-uniform. The slit width $W_S$ must be narrow to reduce inductive effects on the co-polarized current, but not so narrow as to create significant capacitance between the adjacent edges for the cross-polarized current. Depending on the patch width W and the number of slits 14, the width can vary from 0.005W to 0.1W.

Figure 2:
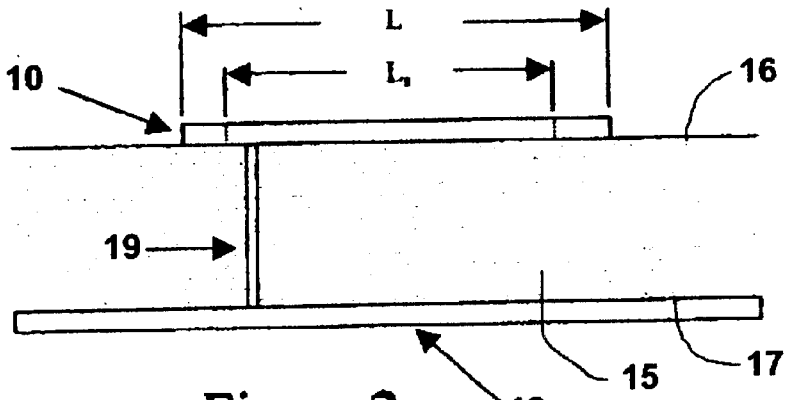
FIG. 2 is a side view of an antenna with a radiator embodying features of the present invention.

As shown in FIG. 2 an antenna with a radiator embodying the features of the present invention has the normal configuration of a microstrip patch antenna and includes a dielectric substrate 15 with an upper surface 16 and a lower surface 17. The printed-circuit patch 10 is located on the upper surface 16 and a metallic ground plane 18 is located on the lower surface 17 of the dielectric substrate 15. A feed probe 19 connected to the patch 10 provides the feed for the radiator. The feed probe 19 is preferably located along a center line of the patch 10 parallel to the slits 14. The presence of the slits 14 does not restrict the use of any standard patch radiator feeding technique such as a coaxial probe, coplanar microstrip line, or slot-coupled microstrip line.

Figure 3:
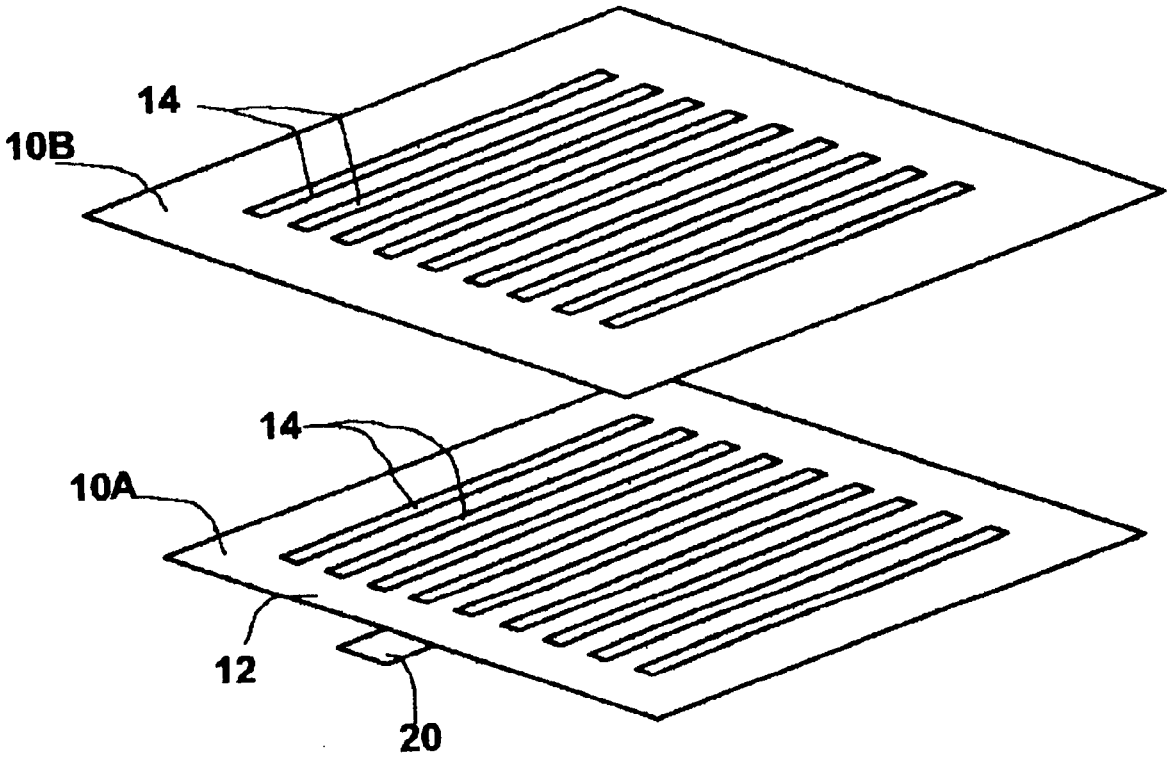
FIG. 3 is a perspective view of two inductively coupled radiators embodying features of the present invention.

As an example, and not a limitation, as shown in FIG. 3, two radiators may be dimensioned for use in a Multichannel Multipoint Distribution System (MDS/MMDS) communication system for the frequencies of 2.15–2.162 GHz and 2.5–2.69 GHz as follows. The lower patch 10A is edge fed with a feed 20 that connected to the center of the first connecting portion 12 and extending therefrom parallel to the slits 14. The upper patch 10B is inductively fed. In this case, multiple, stacked microstrip patches 10 are utilized to achieve the desired dual-band performance (the substrates 15 and ground plane 18 are not shown for clarity). Both patches 10 have slits 14, but with the sizes differing for the two patches 10. The dimensions for each patch are:

| | Lower patch | Upper patch |
|---|---|---|
| L | 41.2 mm | 46 mm |
| W | 41.2 mm | 46 mm |
| $L_S$ | 36 mm | 36 mm |
| $W_S$ | 0.5 mm | 0.5 mm |
| S | 4 mm | 4 mm |
| number of slits | 9 | 9 |
| dielectric thickness | 3 mm | 6 mm |
| dielectric constant | 2.3 | 1.05 |

The slits 14 are located in the desired E-plane patch 10 for the purpose of cross-polarization current and radiation suppression. An antenna may include one or more patches 10 in a planar array and a stacked configuration.

Although the present invention has been described with a certain degree of particularity, it is understood that the present disclosure has been made by way of example and that changes in details of structure may be made without departing from the spirit thereof.

What is claimed is:

1. A low cross-polarization microstrip patch radiator comprising:

a plurality of parallel conductive strips each having a first end and a second end opposite said first end, said strips being spaced to form slits parallel to the direction of desired patch currents, a conductive first connecting portion extending transverse to said strips and connecting to each of said first ends of said strips, and a conductive second connecting portion, spaced from said first connecting portion, extending transverse to said strips and connecting to each of said second ends of said strips.

2. The radiator as set forth in claim 1 including from 4 to 50 of said slits.

3. The radiator as set forth in claim 1 wherein said first connecting portion, said second connecting portion and said conductive strips have radiator width measured perpendicular to said slits, and said slits have a slit width of from about 0.005 to 0.1 times said radiator width.

4. The radiator as set forth in claim 1 wherein said first connecting portion, said second connecting portion and said conductive strips form a rectangular shape having a radiator length measured parallel to said slits, and said slits have slit length that is between 0.5 and 0.9 times said radiator length.

5. The radiator as set forth in claim 1 wherein said first connecting portion, said second connecting portion and said conductive strips form a circular shape having a diameter, with said first and second connecting portions forming portions of an annular band, and said annular has a thickness of between about 0.05 and 0.25 times said diameter.

6. The radiator as set forth in claim 1 including a microstrip feed connected to said first connecting portion, opposite said strips.

7. The radiator as set forth in claim 1 including a coaxial feed probe connected to said first connecting portion.

8. The radiator as set forth in claim 1 wherein said first connecting portion, said second connecting portion and said conductive strips are a single piece of conductive material with said slits being between said strips.

9. A low cross-polarization microstrip patch radiator comprising:

a plurality of parallel conductive strips each having a first end and a second end opposite said first end, said strips being spaced to form slits therebetween, a conductive first connecting portion extending transverse to said strips and connecting to each of said first ends of said strips, and a conductive second connecting portion extending transverse to said strips and connecting to each of said second ends of said strips, said first connecting portion, said second connecting portion and said conductive strips forming a rectangular shape, said rectangular shape having a radiator length measured parallel to said slits and a radiator width measured perpendicular to said slits, said plurality of slits including between 4 and 50 slits with each said slit having a slit length that is between 0.5 and 0.9 times said radiator length, and each said slit having a slit width that is between 0.005 and 0.1 times said radiator width.

* * * * *